US010626624B2

(12) United States Patent
Leuciuc

(10) Patent No.: US 10,626,624 B2
(45) Date of Patent: Apr. 21, 2020

(54) TILE SPACER AND WEDGE TOOL

(71) Applicant: Liviu Leuciuc, Knoxville, TN (US)

(72) Inventor: Liviu Leuciuc, Knoxville, TN (US)

( * ) Notice: Subject to any disclaimer, the term of this patent is extended or adjusted under 35 U.S.C. 154(b) by 0 days.

(21) Appl. No.: 16/144,425

(22) Filed: Sep. 27, 2018

(65) Prior Publication Data

US 2019/0292797 A1 Sep. 26, 2019

Related U.S. Application Data

(63) Continuation of application No. 29/646,232, filed on May 2, 2018.

(60) Provisional application No. 62/648,185, filed on Mar. 26, 2018.

(51) Int. Cl.
*E04F 21/00* (2006.01)
*E04F 21/18* (2006.01)
*E04F 15/02* (2006.01)

(52) U.S. Cl.
CPC .... *E04F 21/0092* (2013.01); *E04F 15/02022* (2013.01)

(58) Field of Classification Search
CPC ... E04F 21/0092; E04F 21/18; E04F 21/1838; E04F 21/1844; E04F 21/1833; E04F 21/185; E04F 21/22; E04F 15/02022; Y10T 33/20; Y10S 33/20
USPC ..... 52/749.11, 474.11, 39, 396.1; 33/527, 33/DIG. 20, 645
See application file for complete search history.

(56) References Cited

U.S. PATENT DOCUMENTS 2,031,684 A * 2/1936 Berger ..... E04F 15/02022 52/396.1
2,930,135 A * 3/1960 Rodtz, Sr. ..... E04F 21/0092 33/518
3,861,098 A * 1/1975 Schaub ..... E01C 3/006 52/98
3,961,453 A * 6/1976 Couwenbergs ..... E04D 11/005 52/509
4,503,654 A * 3/1985 Cosentino ..... E04F 13/0885 428/192
4,793,068 A * 12/1988 Golkar ..... E04F 21/0092 33/518
4,862,668 A * 9/1989 DeGooyer ..... E01C 5/006 52/747.11
4,908,952 A * 3/1990 Joos ..... E04F 13/14 33/526

(Continued)

FOREIGN PATENT DOCUMENTS

EP 1111157 A1 * 6/2001 ..... E04F 21/0092

*Primary Examiner* — Kyle J. Walraed-Sullivan
(74) *Attorney, Agent, or Firm* — Dunlap Bennett & Ludwig PLLC; Brendan E. Squire

(57) ABSTRACT

A tile spacer and wedge tool for installation of tile work. The tool includes a center surface from which one or more of a cross element and a bar element protrude form the center surface. The elements have a width corresponding to a desired spacing between adjoining tiles. An integrally formed wedge extends radially outwardly from a side of the spacer and wedge tool and is substantially aligned with the center surface. The combined tile spacer and wedge tool provides a single spacing tool that may be used for any aspect of a tile work installation, allowing the installer to carry only a single tool. The tile spacer and wedge tool have a more robust construction than conventional spacers, allowing them to be reused for installation work for an indefinite number of uses.

19 Claims, 6 Drawing Sheets

(56) References Cited

U.S. PATENT DOCUMENTS 5,288,534 A * 2/1994 Tavshanjian ..... E04F 21/0092 33/518
5,359,783 A * 11/1994 Smith ..... E04F 21/0092 33/526
5,363,560 A * 11/1994 Makow ..... E04F 15/02016 33/527
5,560,117 A * 10/1996 Tallman ..... G01B 3/30 33/526
5,623,799 A * 4/1997 Kowalski ..... E04F 21/0092 52/391
D492,210 S * 6/2004 Shilo ..... D10/64
6,769,191 B1 * 8/2004 Zusman ..... E04F 21/0092 33/526
6,823,640 B1 * 11/2004 Pytlewski ..... E04F 15/02022 52/396.06
D542,161 S * 5/2007 Skillings ..... D10/64
D542,162 S * 5/2007 Skillings ..... D10/64
7,257,926 B1 * 8/2007 Kirby ..... E04F 21/0092 33/526
D563,744 S * 3/2008 Adwar ..... D8/47
7,650,700 B1 * 1/2010 Blankenship ..... E04F 21/0092 33/527
7,941,987 B1 * 5/2011 Raim ..... E04F 21/0092 33/526
7,984,541 B1 * 7/2011 Davidson ..... B25B 23/00 249/51
D678,039 S * 3/2013 Psaila ..... D8/354
D743,241 S * 11/2015 Nieves, Sr. ..... D8/354
9,322,185 B1 * 4/2016 Russo ..... E04F 21/0092
D758,218 S * 6/2016 Bunch ..... D10/64
D758,899 S * 6/2016 Bunch ..... D10/64
10,056,014 B2 * 8/2018 Meersman ..... G09F 9/3026
D829,532 S * 10/2018 Bunch ..... D8/354
D832,680 S * 11/2018 Bunch ..... D8/354
D832,723 S * 11/2018 Dahill ..... D10/64
D833,260 S * 11/2018 Dumlao ..... D8/354
2002/0121027 A1 * 9/2002 Kruskamp ..... E04F 21/0092 33/526
2002/0148129 A1 * 10/2002 Donnellan ..... E04F 13/14 33/526
2004/0060184 A1 * 4/2004 Shilo ..... E04F 21/0092 33/526
2004/0250435 A1 * 12/2004 Fiore ..... E04F 21/0092 33/527
2005/0214502 A1 * 9/2005 Westthorp ..... E04F 21/18 428/98
2005/0257468 A1 * 11/2005 Serros ..... E04F 13/142 52/396.1
2006/0005910 A1 * 1/2006 Jones ..... E04F 21/04 156/71
2007/0011898 A1 * 1/2007 Frank ..... E04F 21/0092 33/526
2008/0141617 A1 * 6/2008 Joski ..... E04F 21/0092 52/749.11
2009/0126213 A1 * 5/2009 Tavy ..... E04F 21/0092 33/527
2009/0235548 A1 * 9/2009 Higgs ..... E04F 21/0092 33/518
2009/0260317 A1 * 10/2009 Burns ..... E04F 21/0092 52/749.11
2010/0050453 A1 * 3/2010 Bryce ..... E04F 21/0076 33/527
2010/0088912 A1 * 4/2010 Higgs ..... E04F 21/0092 33/527
2012/0023766 A1 * 2/2012 Hillebrandt ..... E04F 15/02005 33/527
2012/0023767 A1 * 2/2012 Trisko ..... B43L 9/04 33/645
2012/0186426 A1 * 7/2012 Ward ..... F41H 5/0414 89/36.02
2012/0198789 A1 * 8/2012 Noutsis ..... E04F 21/0092 52/747.11
2012/0297714 A1 * 11/2012 Tavy ..... E04F 21/0092 52/309.1
2013/0055675 A1 * 3/2013 Sighinolfi ..... E04F 21/0092 52/749.11
2013/0074425 A1 * 3/2013 Miyamoto ..... E04F 13/0839 52/126.7
2014/0116001 A1 * 5/2014 Ghelfi ..... E04F 21/0092 52/749.11
2015/0197946 A1 * 7/2015 Tooma ..... E04F 21/0092 52/747.11
2015/0308130 A1 * 10/2015 Biec ..... E04F 21/0092 52/749.11
2016/0032598 A1 * 2/2016 Anderson ..... E04F 21/0092 206/231
2016/0090746 A1 * 3/2016 Sighinolfi ..... E04F 21/18 33/526
2016/0244975 A1 * 8/2016 Jones ..... E04F 21/0092
2016/0244982 A1 * 8/2016 Bunch ..... E04F 21/0092
2018/0202173 A1 * 7/2018 Bunch ..... E04F 13/0889
2019/0063084 A1 * 2/2019 Bunch ..... E04F 21/22

* cited by examiner

TILE SPACER AND WEDGE TOOL

CROSS-REFERENCE TO RELATED APPLICATION

This application claims the benefit of priority of U.S. provisional application No. 62/648,185, filed Mar. 26, 2018, and is a continuation of U.S. design patent application 29/646,232, filed May 2, 2018, the contents of which are herein incorporated by reference.

BACKGROUND OF THE INVENTION

The present invention relates to tile work, and more particularly to tools to assist in the laying of tile in a structure.

Wedges and spacers have been utilized for many years by tile installers with their simple design changing very little. Traditionally ceramic or clay tile is installed by uniformly spreading an adhesive on a prepared surface. The tile is then installed with the use of alignment tools such as spacers or wedges to ensure their spacing and placement is uniform between each tile.

This uniformity can differ according to designed layout or pattern intended. In many cases this is simply a square matrix however more elaborate layouts exist. Once the adhesive has set the spacer or wedges are no longer needed and are removed. Grout is then used to fill in the space left between the tiles and in some instances the tile is then coated for protection from water (such as in a tile shower).

Spacers and wedges are also used for properly aligning tile with other present structures (such as wall) along the perimeter of the tiled surface. However, the tile installer needs to carry a variety of spacers and wedges in order to complete an installation. Because they are separate tools, the installer needs to keep them separated so that may obtain the desired tool when it is needed.

As can be seen, there is a need for an improved tile spacer and wedge tool to facilitate installation of tile work in an efficient manner.

SUMMARY OF THE INVENTION

In one aspect of the present invention a tile placement tool is disclosed. The tile placement tool includes a center plate defining a flat surface area from which a spacer element protrudes from at least one of a first side and a second side of the center plate. A wedge radially protrudes from a side edge of the center plate.

The spacer element may include a cross shaped spacer protruding from the first side of the center plate. The spacer element may also include a bar shaped spacer protruding from a second side of the center plate.

In some embodiments, an aperture is defined in a central portion of the center plate. The cross shaped spacer and the bar shaped spacer may overlap the aperture. The width of the spacer element corresponds to a desired separation of a tile joint.

In some embodiments, the wedge has a tapering thickness with a maximum thickness at a point proximal to the side edge of the center plate and a minimum thickness at a point distal from the side edge of the center plate. A plurality of ridges may define a stepped tapered surface on a first side of the wedge. A smooth surface may define a tapered surface on a second side of the wedge.

In other aspects of the invention, a tile placement tool includes a center plate defining a flat surface area from which a spacer element protrudes from at least one of a first side and a second side of the center plate. A wedge protrudes from a side edge of the center plate. The wedge has a tapering thickness with a maximum thickness at a point proximal to the side edge of the center plate and a minimum thickness at a point distal from the side edge of the center plate.

The spacer element may include a cross shaped spacer protruding from the first side of the center plate and a bar shaped spacer protruding from the second side of the center plate. An aperture may be defined in the center plate and arms of the cross shaped spacer extend across the aperture.

In some embodiments, a first side of the wedge has a stepped tapered surface. In other embodiments, a second side of the edge has a smooth tapered surface.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

Broadly, embodiments of the present invention provides a tile spacer and wedge tool 10 that combines the utility of a tile spacer and a wedge into a single durable product. The tile spacer and wedge tool 10 will eliminate the need for tile installers to carry both types of devices. By combining both the functionalities of a spacer and wedges there will be an increase in the durability of both by creating a larger single device to hold onto while removing it, thereby reducing breakage that occurs during the process.

Figure 1:
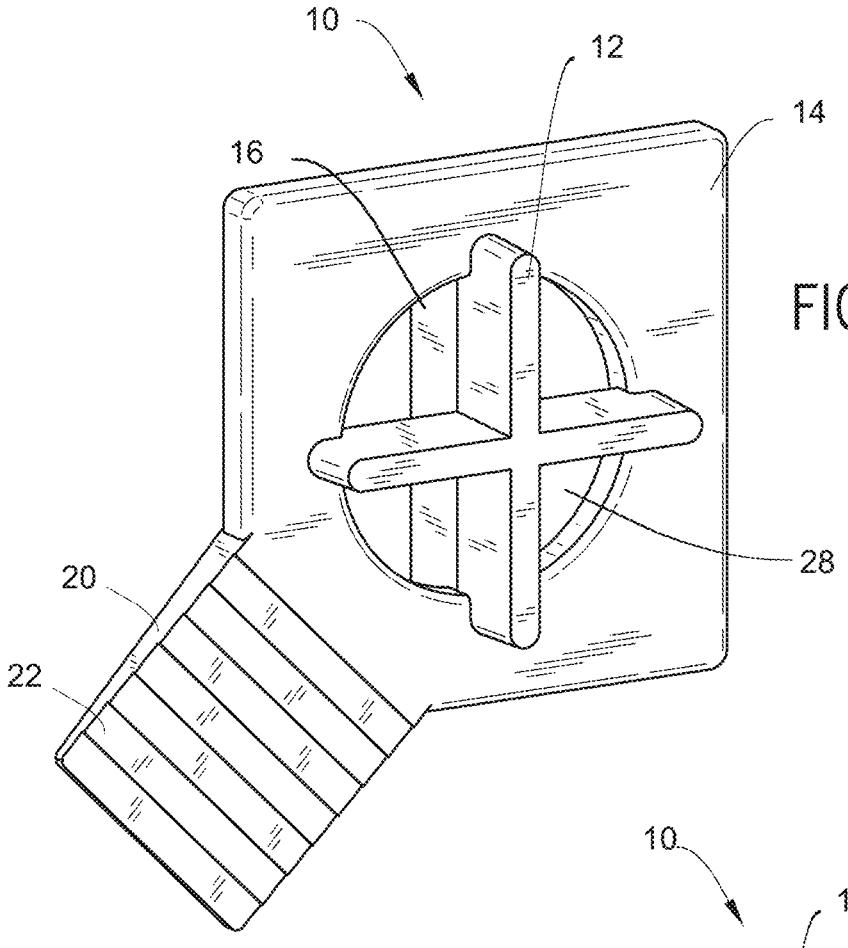
FIG. 1 is a front perspective view of a tile spacer and wedge tool showing my new design.

The tile spacer and wedge tool 10 may be made from an ABS plastic, or other high strength plastics, which will give it the desired strength and durability for its intended purpose. This will also give it the ability to be reused indefinitely. The tile spacer and wedge tool 10 will work with both wall and floor tile installations. In preferred embodiments, the tile spacer and wedge tool 10 will have a cross spacer element 12 on a first side 14 of the device, such as shown in reference to FIG. 1 and a straight (or bar) spacer 16 defined on a second side 18 of the device, such as shown in reference to FIG. 2.

A center plate 11 of the device may be formed as a flat surface area from which the respective cross 12 and bar 16 spacer elements protrude. By way of non-limiting example, the center surface may be formed as a roughly 1.75 inch by 1.75 inch square. The center surface may have a thickness that is on the order of ⅛ of an inch thick. The cross 12 and bar 16 elements that protrude from the sides of the center surface may be dimensioned to have a width corresponding to a desired spacing of the tiling to be laid.

The tile spacer and wedge tool 10 has at least one a wedge 20 that protrudes from and substantially aligned with the center surface. The wedge 20 is integrally formed with and may extend radially outwardly from the center surface. The wedge 20 may have a width of approximately ⅝". The wedge may be formed to have a variable thickness along its longitudinal length, with a maximum thickness proximal to the center surface and a minimum thickness distal to the center surface. The wedge thickness may for example taper from roughly ⅛ inch at its base to zero.

The length of the wedge may be on the order of one inch. As seen in reference to FIG. 3, the wedge may also include a plurality of small spaced apart ridges 22 running laterally across its width, which may be 1/32 of an inch perpendicular to the flat surface of the wedge 20 on at least one of the top 24 and bottom 26 surfaces of the wedge. The ridges 22 may be engaged with a top edge of the tile 30 to retain the wedge 20 at the desired elevation and width. This will allow the spacer 10 to be used in a four-tile joint or a staggered pattern and allow the wedge 20 to be used as needed. An opposite side of the wedge 20 may have a substantially smooth surface. The top 24 and bottom 26 surfaces converge inwardly from the proximal end to the distal end of the wedge 20.

Figure 8:
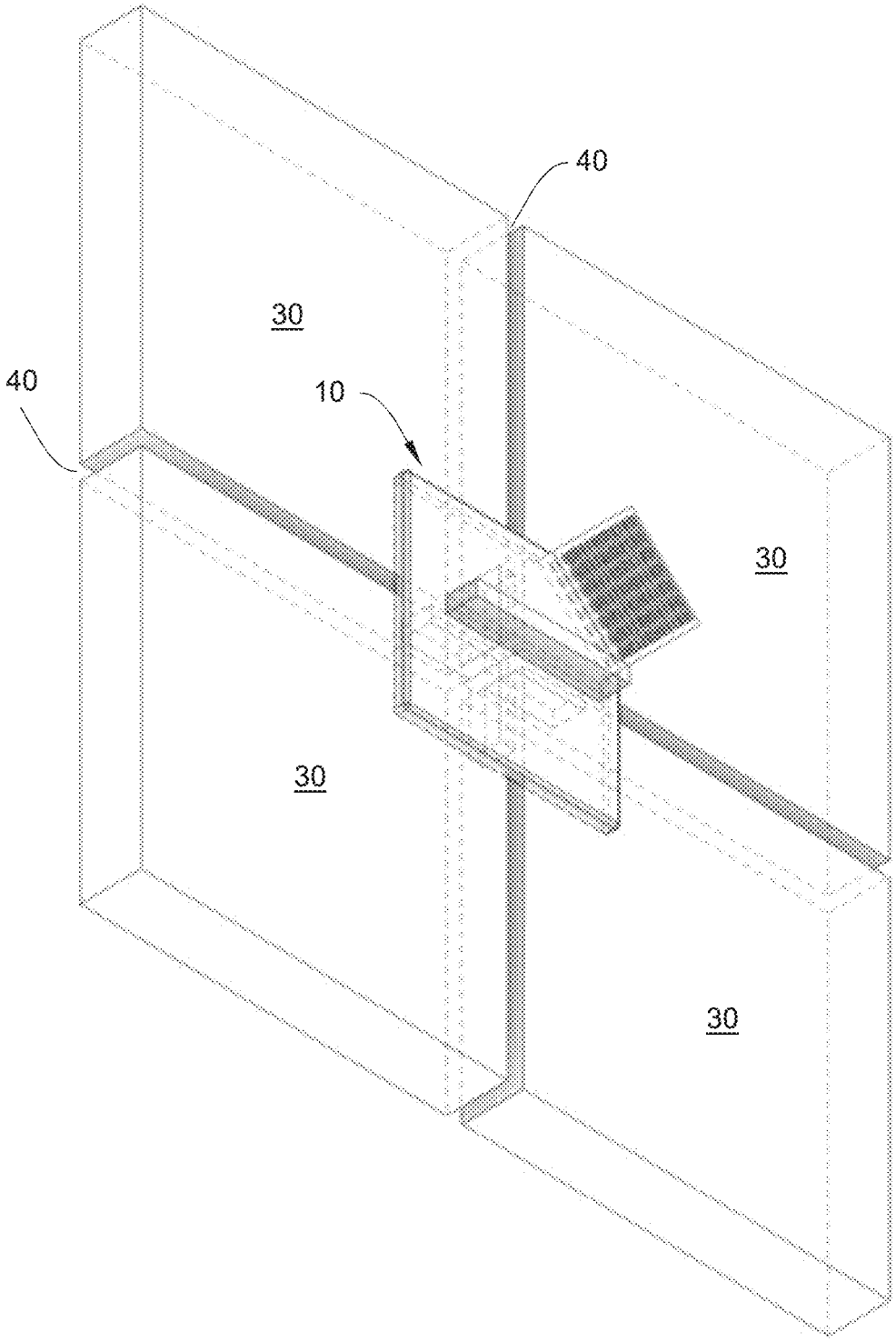
FIG. 8 is a perspective view of a cross spacer side shown in use in placing tiles.

As seen in reference to FIG. 8, the tile spacer and wedge tool 10 is illustrated in use for a four tile installation. In this case, the tile installer would use the cross element 12 to position and space the side edges for four adjoining tiles 30. With the tile spacer and wedge tool 10 in place, the wedge 20 provides a convenient lifting tab to remove the spacer and wedge tool when the installed tiles 30 and adhesives have set.

Figure 9:
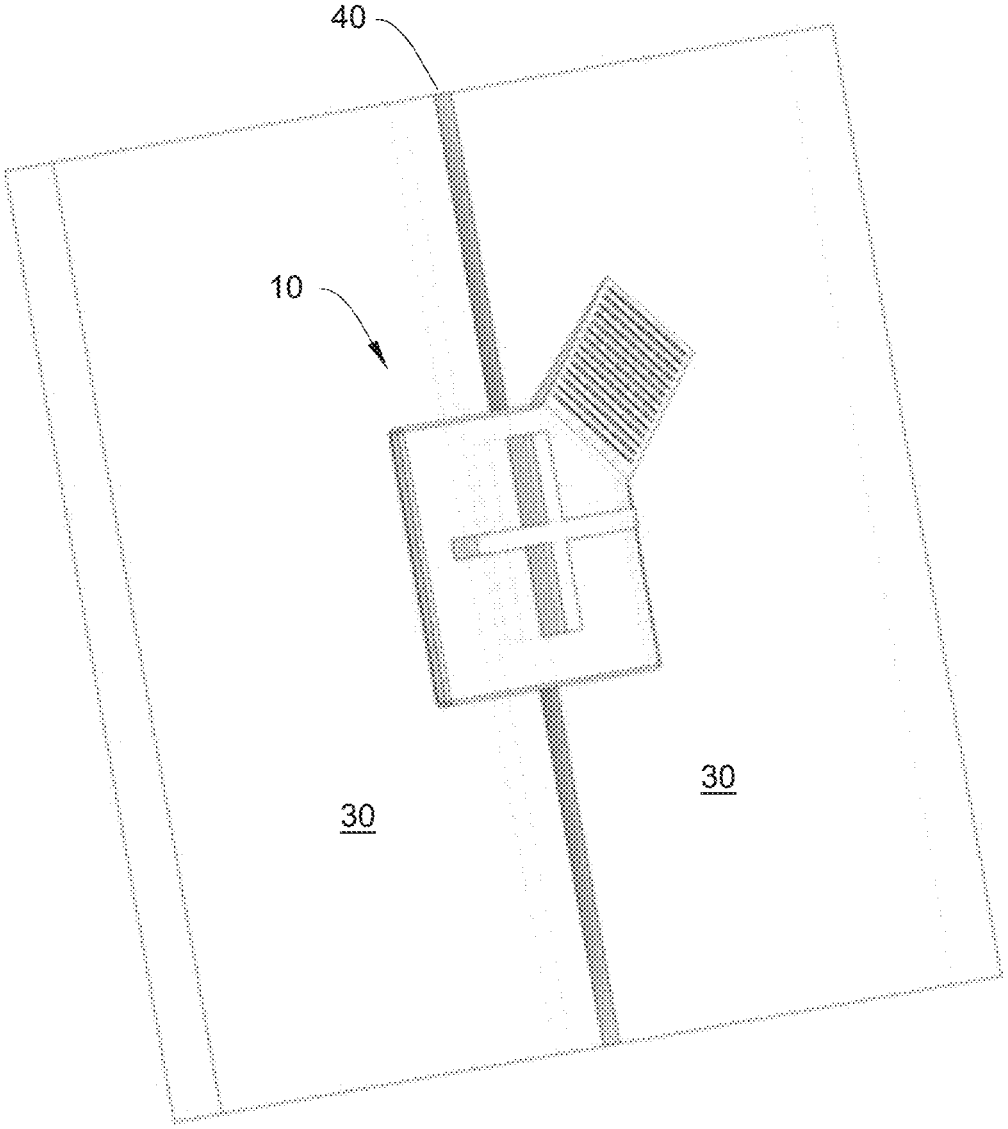
FIG. 9 is a perspective view of a bar spacer side shown in use in placing tiles.

As seen in reference to FIG. 9, the tile spacer and wedge tool 10 is illustrated in use with a two tile 30 installation as a spacer between two adjacent tiles 30. In this instance, the bar element 16 is placed between adjacent side edges of the tiles 30 to maintain their spacing while the adhesives set. Once the adhesive has set the spacer and wedge tool 10 are no longer needed and are removed.

As will be appreciated, spacers and wedges are also used for properly aligning tile 30 with other present structures (such as wall) along the perimeter of the tile work. The installer would use it during tile installation to maintain the desired joint size on floors or walls. By simply flipping the tool 10 sideways, the wedge 20 can be used to maintain a consistent joint in a corner where two tile walls meet. The wedge 20 would allow the installer to make minor adjustments to the joint 40 as needed based on tile or job specs all while using just one device.

Figure 2:
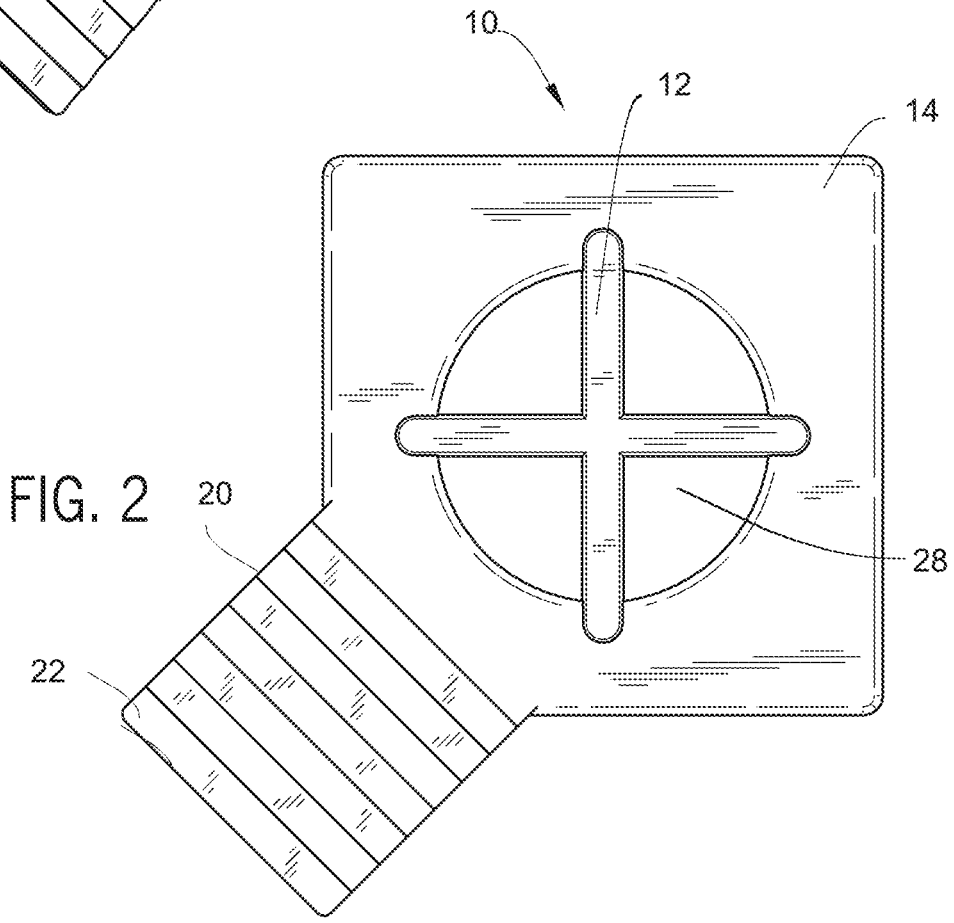
FIG. 2 is a front elevation view thereof.
Figure 5:
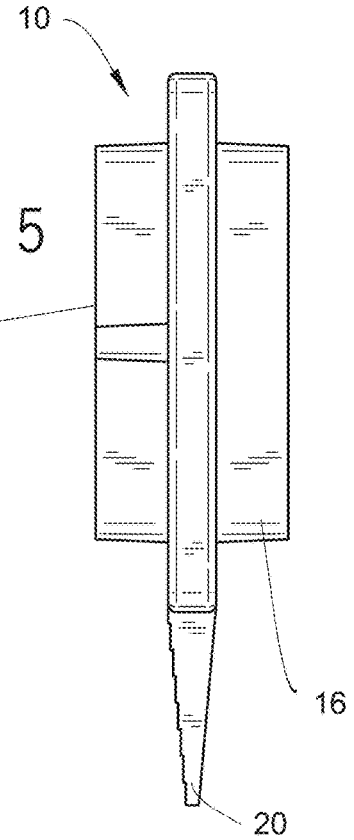
FIG. 5 is a right side elevation view thereof.
Figure 6:
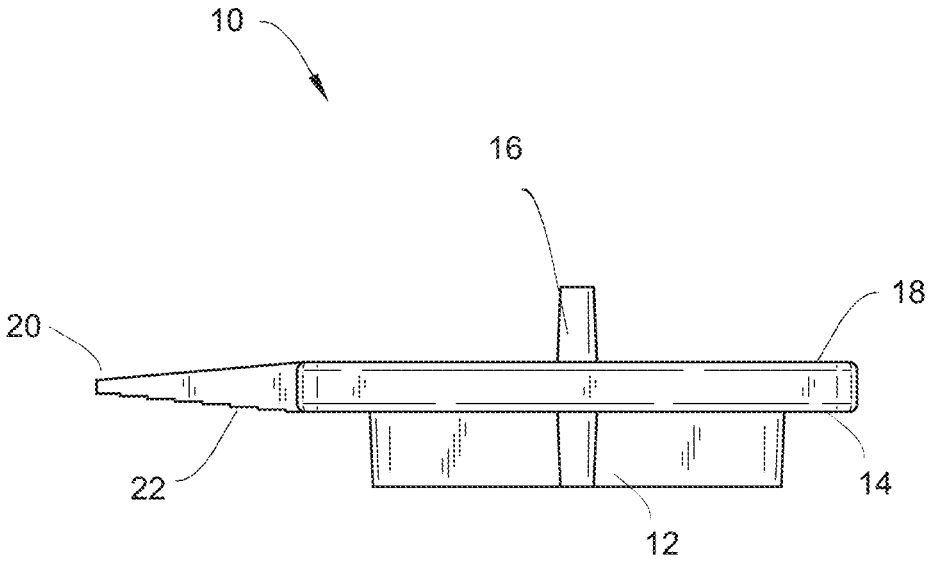
FIG. 6 is a top plan view thereof.

FIG. 2 shows the bar spacer 16 side of the device 10 and its use between two tiles can be seen in FIG. 5. The bar spacer 16 is typically utilized when larger tile 30 is being installed and a spacer is needed in the middle or end of the tile 30, that is for areas where four tile corners do not meet. When installing a pattern known as "subway tile" the horizontal joints are staggered, and the bar spacer 16 can be used in conjunction with the wedge 20 to ensure uniformity in tile placement. In this case when the bar 16 is being utilized the cross spacer 12 and wedge 20 can be used as a grip for removal of the device 10.

Figure 3:
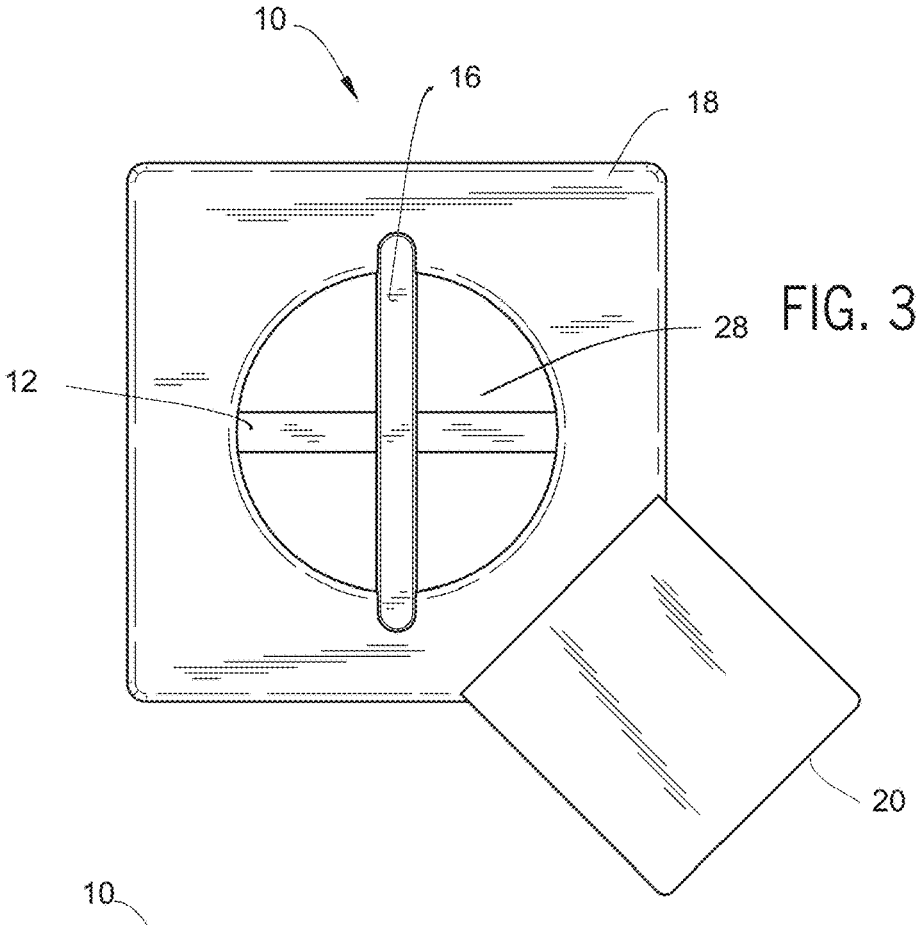
FIG. 3 is a rear elevation view thereof.
Figure 4:
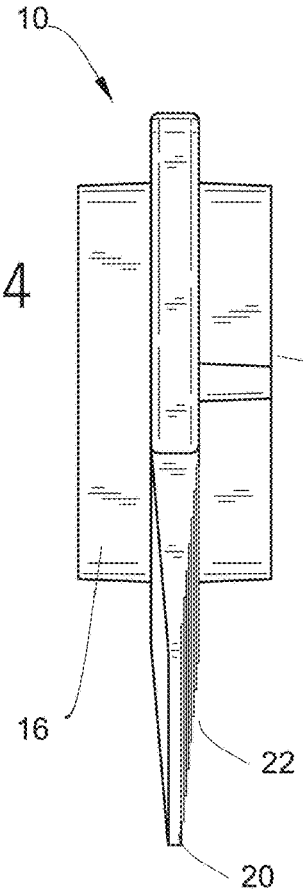
FIG. 4 is a left side elevation view thereof.

FIG. 3 shows the relative thickness of the device 10 as well as the tapering thickness of the wedge 20. Wedges 20 have the utility of providing a smaller spacing for joints 40 between tiles 30 to provide uniform spacing where one or more tiles 30 may vary in spacing from the remainder of the tile work. Examples may include spacing between the edge tiles 30 and a wall or other surface adjoining the edge of the tile work. If the cross 12 or bar spacer 16 is too wide for the spacing, the wedge 20 can be utilized to provide a uniform spacing that may range from almost no joint up to ⅛ of an inch, or the selected maximum thickness of the wedge 20.

Figure 7:
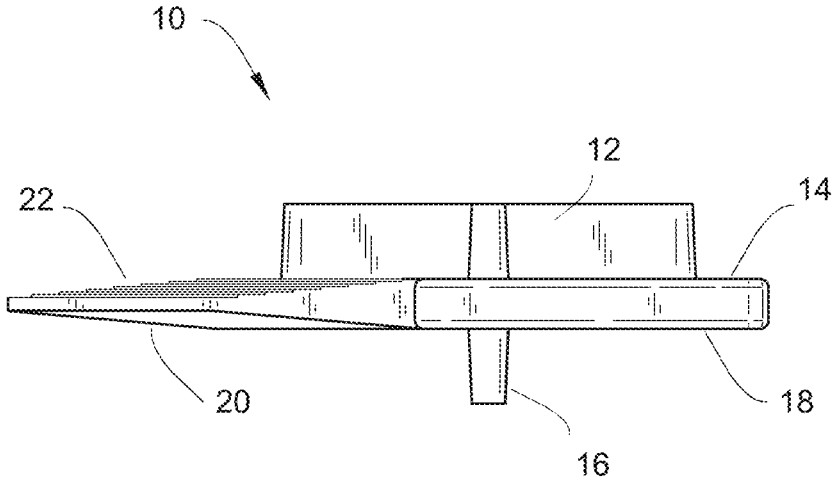
FIG. 7 is a bottom plan view thereof.

An alternative embodiment of the tile spacer and wedge tool 10 is shown in reference to FIGS. 7-9. In this embodiment an aperture 28 is defined through the center surface. The aperture 28 facilitates the placement of the tile spacer and wedge tool 10 by allowing the installer to see the desired joint 40 between the adjacent tiles 40 in which the tile spacer and wedge tool 10 is to be applied.

Figure 10:
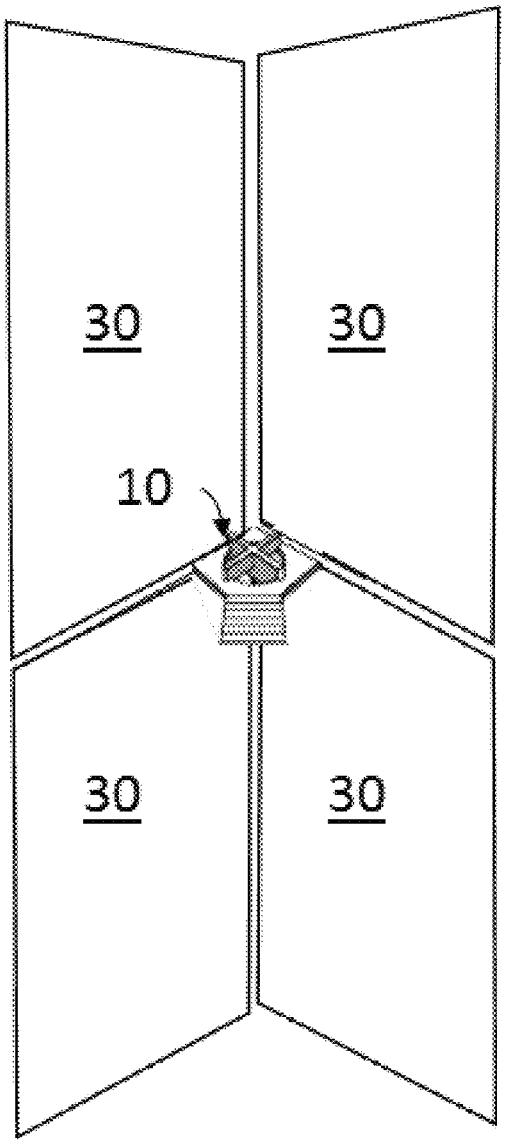
FIG. 10 is a perspective of the tile spacer and wedge tool shown in use applied to a corner.

As seen in reference to FIG. 10, the tile spacer and wedge tool 10 is applied to a corner of a tiled structure. The lateral edge surfaces opposite the wedge 20 may be positioned between adjacent tiles 30 at a corner of a structure. The orthogonal edge surfaces opposite the wedge 20 allow the spacer to be positioned within the corner while providing the desired spacing between the adjacent tiles 30. While illustrated applied to a vertical corner of a structure, the tile spacer and wedge tool 10 may be utilized in a corner between a vertical wall and a horizontal structural surface as well.

It should be understood, of course, that the foregoing relates to exemplary embodiments of the invention and that modifications may be made without departing from the spirit and scope of the invention as set forth herein.

What is claimed is:

1. A tile placement tool, comprising:

a rectangular center plate defining a flat surface area having a length from which a spacer element protrudes from at least one of a first side and a second side of the flat surface area of the rectangular center plate wherein the rectangular center plate extends beyond a periphery of the spacer element; and a wedge is attached to and radially protrudes from the rectangular center plate in a common plane with the length of the rectangular center plate.

2. The tile placement tool of claim 1, wherein the spacer element comprises a cross shaped spacer protruding from the first side of the rectangular center plate.

3. The tile placement tool of claim 2, wherein the spacer element comprises a bar shaped spacer protruding from a second side of the rectangular center plate.

4. The tile placement tool of claim 3, further comprising an aperture defined in a central portion of the rectangular center plate.

5. The tile placement tool of claim 4, wherein the cross shaped spacer and the bar shaped spacer overlap the aperture.

6. The tile placement tool of claim 5, wherein a width of the spacer element corresponds to a separation of a tile joint.

7. The tile placement tool of claim 1, the wedge further comprising:

a tapering thickness having a maximum thickness at a point proximal to the rectangular center plate and a minimum thickness at a point distal from the rectangular center plate.

8. The tile placement tool of claim 1, further comprising:

a plurality of ridges defining a stepped tapered surface on a first side of the wedge.

9. The tile placement tool of claim 8, further comprising:

a smooth surface defining a tapered surface on a second side of the wedge.

10. A tile placement tool, comprising:

a center plate defining a flat surface area having a length from which a spacer element protrudes from at least one of a first side and a second side of the flat surface area of the center plate; and a wedge radially protrudes from a lateral side edge of the center plate, the wedge having a tapering thickness with a maximum thickness at a point proximal to the lateral side edge of the center plate and a minimum thickness at a point distal from the side edge of the center plate the wedge protruding along a plane parallel with the length of the flat surface area; and wherein the center plate extends beyond a periphery of the spacer element.

11. The tile placement tool of claim 10, wherein the spacer element comprises:

a cross shaped spacer protruding from the first side of the center plate; and a bar shaped spacer protruding from the second side of the center plate.

12. The tile placement tool of claim 11, further comprising:

an aperture defined in the center plate; and arms of the cross shaped spacer extend across the aperture.

13. The tile placement tool of claim 10, wherein a first side of the wedge has a stepped tapered surface.

14. The tile placement tool of claim 13, wherein a second side of the wedge has a smooth tapered surface.

15. A tile placement tool, comprising:

a center plate defining a flat surface area from which a spacer element protrudes within a peripheral edge surface of the center plate from at least one of a first side and a second side of the center plate;

a wedge protrudes from a side edge of the center plate along a common plane of corresponding to a length of the center plate; and wherein the center plate extends beyond the peripheral edge surface of the center plate.

16. The tile placement tool of claim 15, the wedge having a tapering thickness with a maximum thickness at a point proximal to the side edge of the center plate and a minimum thickness at a point distal from the side edge of the center plate.

17. The tile placement tool of claim 15, further comprising:

an aperture defined in the center plate; and arms of a cross shaped spacer extend across the aperture.

18. The tile placement tool of claim 15, wherein a first side of the wedge has a stepped tapered surface.

19. The tile placement tool of claim 18, wherein a second side of the edge has a smooth tapered surface.

* * * * *